United States Patent [19]

Dunn et al.

[11] Patent Number: 4,935,971

[45] Date of Patent: Jun. 26, 1990

[54] IN-BED BATHING PROCESS AND APPARATUS THEREFOR

[76] Inventors: Mignon A. Dunn, 3662-8 Vista Campana North, Oceanside, Calif. 92056; Scott Postle, 741 W. 17th St., Long Beach, Calif. 90813

[21] Appl. No.: 357,800

[22] Filed: May 30, 1989

Related U.S. Application Data

[63] Continuation-in-part of Ser. No. 106,222, Oct. 8, 1987, abandoned.

[51] Int. Cl.[5] ..... A47K 3/062

[52] U.S. Cl. ..... 4/559; 4/516; 4/546; 4/585

[58] Field of Search ..... 4/538, 516, 546–549, 4/559, 560, 571, 573, 585, 586; 128/365, 369

[56] References Cited

U.S. PATENT DOCUMENTS

| | | | |
|---|---|---|---|
| 1,954,940 | 4/1934 | Mikel | 4/575 |
| 2,471,302 | 5/1949 | Boward | 4/547 X |
| 3,469,266 | 9/1969 | Hyde | 4/585 X |
| 3,677,263 | 7/1972 | Allen | 128/365 X |
| 3,681,789 | 8/1972 | Bott | 4/547 X |
| 3,961,380 | 6/1976 | Garr | 4/573 X |
| 4,055,863 | 11/1977 | Duval | 128/365 |
| 4,068,326 | 1/1978 | Deschler | 4/547 X |
| 4,152,792 | 5/1979 | Glintz | 4/546 X |
| 4,419,774 | 12/1983 | Hajek | 4/516 X |

FOREIGN PATENT DOCUMENTS

| | | | |
|---|---|---|---|
| 144772 | 9/1903 | Fed. Rep. of Germany | 4/585 |

*Primary Examiner*—Charles E. Phillips
*Attorney, Agent, or Firm*—John J. Murphey

[57] ABSTRACT

An in-bed bathing process and apparatus therefor comprising the steps of filling one compartment of a sealed tank, internally divided by a flexible diaphragm into two compartments, with pressurized water to distend the diaphragm into the other compartment, moving the water-filled tank to the bedside of the bed-ridden person, encasing the person in a body-encapsulating, water-proof sheath, pressurizing some of the water from the tank into the sheath through a transfer line, for bathing the person, connecting a shower nozzle to the transfer line and rinsing the person, then draining the rinse water from the sheath through another line into a bag hung next to the tank, and including provisions for placing a wash tray behind the person's head for washing their hair in the bed and draining the water into the sheath for capture in the bag.

8 Claims, 2 Drawing Sheets

IN-BED BATHING PROCESS AND APPARATUS THEREFOR

CROSS-REFERENCE TO RELATED APPLICATIONS

This application is a continuation-in-part of a previous application, Ser. No. 07/106,222, filed Oct. 8, 1987, now abandoned.

BACKGROUND OF THE INVENTION

1. Field of the Invention

This invention pertains to the field of personal health care equipment. More particularly, it pertains to a process of bathing an individual, who is confined to a bed, and a unique apparatus therefor, such as to enable one to receive body treatments such as bathing, massage and other ministrations without contact between the provider of the services and the recipient thereof.

2. Description of the Prior Art

In providing health care, those in need are often gathered together to be treated by teams of specialists so that the efficiency of the treatment is intensified or that the total cost thereof is concentrated to be more efficacious. For instance, in hospitals, sanitariums and retirement centers, sick, infirm and aged persons in need of ministrations such as massage, physical therapy of the limbs and bathing are treated by teams of nurses, doctors and others who perform these services without traveling beyond the confines of the institution. In some situations, a single provider of services such as a physical therapist or a nurse may provide frequent bathing and exercise or massage services to a number of individuals during any given period of time. Because of this intensity, those providers tend to suffer from the constant physical contact that is involved in providing these services.

One can perceive, therefore, that a nurse giving baths to a number of patients would soon find his/her hands becoming sore from the loss of body oils through constant exposure to water and soap used in the bathing process. In addition, physical therapists find their hands become sore through abrasion and friction that come about as a result of frequent contact with the patient's skin. In other situations, individuals in need of specialized care are confined to their homes such as those who are aged and those who suffer from acquired immune deficiency syndrome (AIDS). The individual is virtually hopelessly confined to a bed and is too weak to leave the bed and travel to a shower stall and stand or sit to bathe. In these situations, there is a critical need to provide the services to the person in the bed and, further, to bar any direct contact between the patient's body and the provider's body.

Still further individuals who are often in need of specialized services are confined to rooms that have no pressurized water outlet or water drain. In these situations, giving baths to the bed-ridden are confined to filling a bowl with water in a distant water source, carrying it from the water source to the bed, bathing the individual carefully so as not to wet the bed clothing, carrying the bowl back to the distant water drain, etc. This is very time-consuming and fraught with the potential for spilling water and wetting the bed clothes.

The prior art has attempted to provide a barrier to such contact between those who are in need of such services and those who provide such services, with the use of rubber and plastic gloves on the hands of the provider. However, these have not become popular because of their aesthetics. The prior art shows certain apparatuses for bathing, such as are described in U.S. Pat. Nos. 3,749,064; 4,057,032; and, 4,083,328. These devices, however, are generally restricted to placement over a tub or other container that already is provided with pressurized water and a water drain and are not useful for individuals lying in a bed separated from such a source of pressurized water or such a drain.

The prior art further shows certain body treatment apparatuses such as are described in U.S. Pat. Nos. 3,868,950; 4,034,424; 4,152,792; 4,353,359; and, 4,485,502. However, all of these devices are restricted to having a person encased in some sort of apparatus resting in one position only so that they cannot turn or be turned over to expose other portions of their body for treatment. Other forms of prior art have provided apparatus, including pumps and other water-transfer devices, often powered by electrical motors, for transmitting water from one point to another. These devices pose a constant danger to both the provider and the recipient because of the use of water or watercontaining compounds in the presence of electrical energy and the possibility of electrocution, and are otherwise very costly thus placing them beyond the reach of many patients with limited financial means.

One of the inventors herein has previously patented a portable bathing capsule. see U.S. Pat. No. 3,677,263, that utilizes an elongated sheath of water-tight material dimensioned to surround the body wherein means are provided for ingress and egress of fluids. The sheath is entered through an elongated opening having a sealable seam and the inside of the sheath is covered with a liner. This product has worked well over the years, however, it, too, has its own shortcomings and is useful only when coupled with expensive pumps and machinery to transfer water to and from the sheath.

There thus exists a continuing problem in the industry concerning home care or concentrated care, where the individual is confined to a bed and further, where the individual is suffering from a malady mandating a continuous, impervious barrier be established between the provider of services and the recipient. To date, there has been no such apparatus that is safe for use without the attendant problems of possible electric shock or that is totally portable and can be moved from a source of pressurized water to the bedside of the individual and that can be moved between individuals. Finally, in addition, there is a continuing existing problem because of the short-coming in present prior art devices to allow a person's hair to be washed while confined to a bed in a supine or prone position without the attendant problems caused by wetting the bed linen or the bed clothing of the recipient.

SUMMARY OF THE INVENTION

This invention comprises a novel in-bed bathing process that may be utilized in areas where there is no pressurized water source or drain and does not require the need for any electricity. In addition, this novel bathing process provides a continuous barrier between the patient and the provider of the services in order to reduce irritation to the skin and to completely eliminate the possibility of transmission of diseases therebetween. This invention includes a novel apparatus for providing such an in-bed bathing process on a continuing basis so that, after one loading of the apparatus with bath water, more than one bath can be provided to more than one individual. Finally, this inventive apparatus provides a means for easily and quickly washing the hair of an individual who is confined in bed without the attendant difficulties of wetting the bed clothing and bed linen.

This novel in-bed bathing process comprises the steps of providing a full-length, body-encapsulating, water-impervious sheath containing an elongated slot through which the person enters and lies encapsulated while in a supine position on a bed, providing a sealed tank containing an internal flexible diaphragm that divides the tank interior into first and second compartments one of which is thereafter filled through a flexible hose with warm water, forcing the diaphragm to flex toward the second compartment and thereby raise the internal pressure of the water that is placed in the tank, disconnecting the hose from the source and moving the water-filled tank to the bedside of the bed-ridden person, connecting the hose through an aperture into the sheath through a one-way valve and thereafter transferring some of the water from the tank into the sheath, thereafter connecting the hose to a shower nozzle so that, following the bathing of the person, either alone inside the sheath or by the use of rubbing the person's body with the provider's hands on the outside of the water-impervious sheath, the elongated opening in the sheath may be opened and the person showered down and rinsed with water in a fine spray, providing an empty fluid-impervious rinse-water drain bag and a connecting hose between the bag and the sheath so that the rinse water may be transferred into the bag and thereafter discarded. The process further includes a novel method of placing a dish containing upstanding sidewalls under the person's head, the dish having a narrow extended tongue portion that is inserted into the body-encapsulating sheath under the person's neck and thereafter washing the person's hair and using the shower nozzle and the water in the tank to rinse the person's hair thereby allowing the rinse water to run down under the person's neck through the sheath and out into the rinse-water receiving bag.

The novel apparatus that employs this bathing process comprises a sealed tank containing the internal flexible diaphragm as aforesaid, the tank mounted in a cart containing wheels for moving it from place to place, a flexible hose connected to one of the compartments in the tank and adapted to be connected to a pressurized water source for filling the tank with warm water so that the diaphragm flexes into the other compartment to pressurize the water, providing the full-length, body-encapsulating sheath and connecting the hose from the tank to the sheath and thereafter transferring the pressurized water from the tank to the sheath and following that, rinsing the individual using a novel shower nozzle having a one-way, normally-closed valve that is hand-operated to allow control of the flow of water from the tank and thereafter providing the rinse-water receiving bag and hose for collection of the rinse water draining from the sheath.

Accordingly, this invention is a novel in-bed bathing process and apparatus therefor, allowing bathing of a person confined to a bed, in an environment that does not require electrical energy, a pressurized water source or a water drain so that it is useful in the home as well as in hospitals and retirement centers. Other objects of the invention include a novel in-bed bathing process and apparatus therefor, for use by nurses, doctors, physical therapists, as well as non-professionals, providing a barrier between the recipient of the services and the service provider so that the provider's hands and other portions of their anatomy exposed to the person receiving the treatment are not debilitated in any way, either through long exposure, frequent contact or possibly contaminated by undesirable ailments such as AIDS or other maladies.

Further objects of this invention include a device that is totally self-contained, that provides a source of pressurized warm water for use in an area that is not serviced by pressurized water, an apparatus that is useful in providing total bathing of an individual without the need for near-by drains or other connections, a novel apparatus for use in providing hair-washing services to an individual while lying in a bed without wetting or otherwise damaging the bed linen or the person's bed clothes, a device for providing in-bed bathing that does not need to be sterilized following the bathing of an individual but that may be used continuously to bathe different persons with the use of disposable body-encapsulating sheaths and disposable rinse-water collection bags. These and other objects of the invention will become more apparent upon reading the description of the preferred embodiment that follows along with the drawings attached hereto. The scope of protection sought by the inventors may be gleaned from a fair reading of the claims that conclude this specification.

DESCRIPTION OF THE PREFERRED EMBODIMENT

Figure 1:
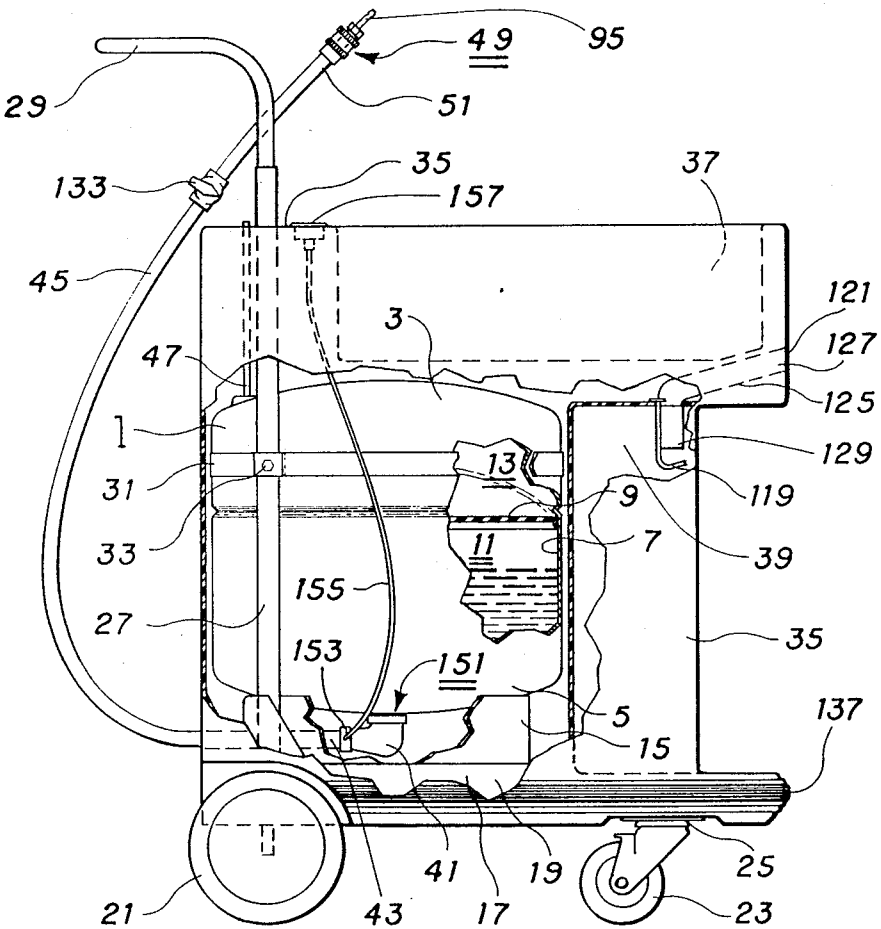
FIG. 1 is a side elevation plan view, partly fragmentary, of one embodiment of the tank and cart of this invention.

The novel in-bed, portable bathing apparatus of this invention is shown in part in FIG. 1 to comprise a hollow tank 1 defined by top tank end 3 and bottom tank end 5 that are fixed in spaced-apart relation by a curved side wall 7 all held together through welding or other joining processes, said tank constructed of sufficiently strong material such as steel to withstand internal pressures on the order of 50 psi. An internal diaphragm 9 is arranged horizontally between tank top end 3 and bottom end 5 and sealed against tank side wall so as to divide the interior into a first compartment 11 and a second compartment 13. Tank 1 is supported on a circular collar 15 that engages the outside of bottom tank end 5.

A cart 17 is provided that comprises a base plate 19 which is supported on a pair of spaced-apart rear wheels 21 and a centered front wheel 23, said front wheel 23 joined to base plate 19 through a horizontally mounted bearing 25 so as to be pivotable through 360° for steering. A pair of spaced-apart, upstanding handle support rods 27 extend upward from base plate 19 near rear wheels 21 and support an outwardly and rearwardly projected hand bar 29 for use in steering cart 17 over the floor.

Tank 1 is mounted inside cart 17 with its support collar 15 resting atop base plate 19 and is held fast thereto by a strap 31 that encircles tank side wall 7 and is anchored to handle support rods 27 through bolts and nuts 33. A cover 35 encloses cart 17 and has formed in the top thereof a depression 37 for use in storing certain items, and an open front compartment 39 for use as later specified. A pipe and elbow 41 is connected to tank bottom end 5 to which is attached one end 43 of a flexible hose 45 so that first compartment 11 is in communication with the exterior of tank 1. Second compartment 13 is totally sealed and contains a combination air vent-/air pressurizing valve 47 to regulate the air pressure therein. Means 49 are provided at the other end 51 of hose 45 for connecting said hose to a source of pressurized water such as a spigot in a janitor's closet or in a kitchen. Numerous forms of connection means are contemplated in this invention; shown in FIG. 1, means 49 is a female quick-disconnect fitting commercially available, that can be snapped into contact with a male fitting (not shown) attached to the spigot.

Figure 2:
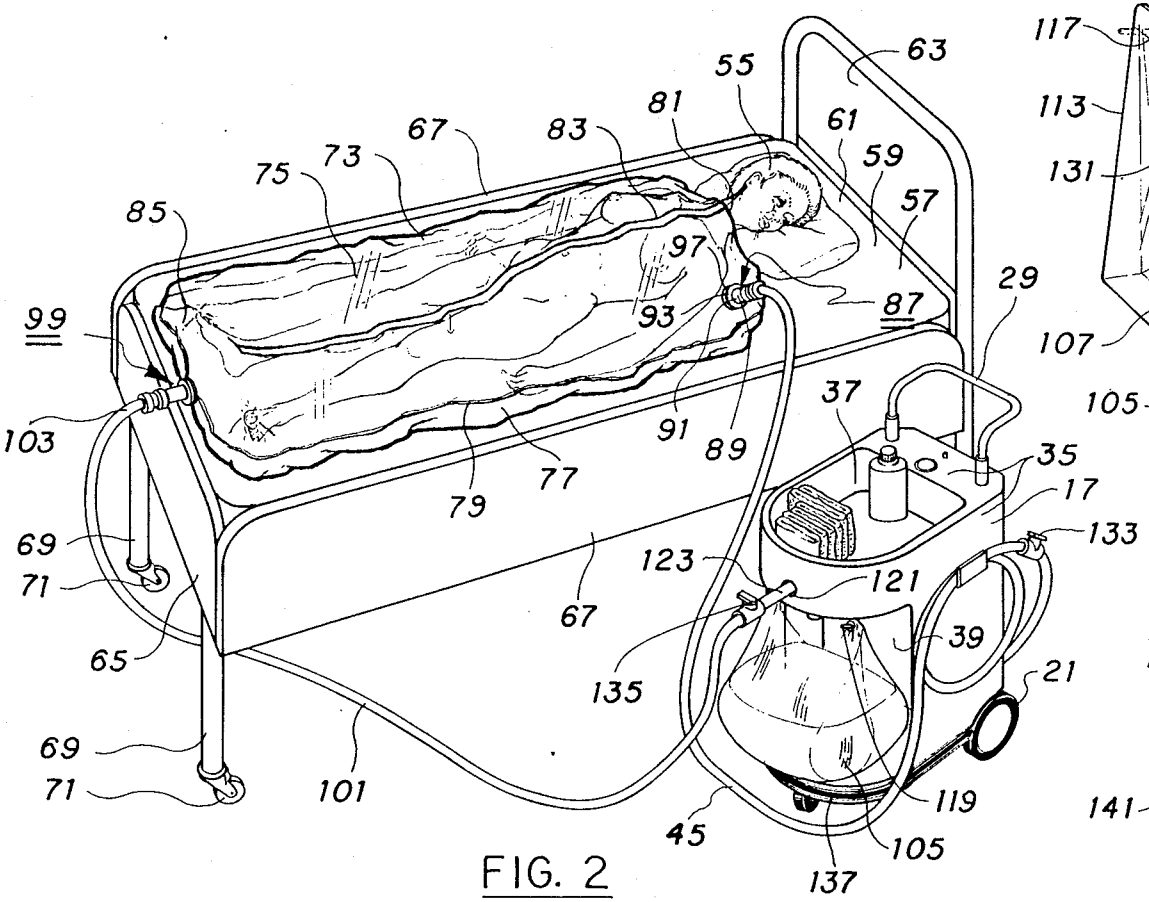
FIG. 2 is an illustrative view of one embodiment of the inbed bathing apparatus of this invention showing its use on a bed-ridden person.

In FIG. 2 is shown a patient 55 lying in a supine position on the top surface 57 of a typical bed mattress 59 supported on a typical bed 61. Bed 61 may be of any general or specific type; as shown in FIG. 2, the bed comprises spaced-apart head board and foot board 63 and 65 respectively, connected at their extremities by a pair of spaced-apart parallel side boards 67 to form a rectangle supported on a floor or other surface by legs 69 and rollers 71, wherein mattress 59 is supported by slats or other arms (not shown) that span the undersides of side boards 67.

The body-encapsulating treatment device of this invention further comprises a water or fluid-impervious sheath 73 that is of a dimension in length and breadth sufficient to accommodate and completely enclose patient 55 except for the patient's head, and generally comprises spaced-apart over-body portion 75 and underbody portion 77 joined about their periphery 79, except for a neck enclosing portion 81, by known means such as heat-sealing, adhesives and the like. Over-body portion 75 and under-body portion 77 are of a length and width sufficient to permit patient 55 to turn over inside sheath 73 from a prone position to a supine position and back without interference with the sheath itself. Sheath 73 may be made from a wide variety of water-impervious materials including polyethylene film, polypropylene film and the like.

An elongated slot or opening 83 is provided in over-body portion 75 generally starting at neck-enclosing portion 81 and passing downward central thereof to a foot-end portion 85 spaced at the other end of sheath 73 from neck-enclosing portion 81. The dimension of slot 83 is established to permit passage therethrough of the patient's body when sheath 73 is stretched out alongside patient 55 the patient is rolled first to one side and one flap of over-body portion 75 moved under the patient, then the patient rolled to their other side where the other flap of over-body portion 75 is moved under them.

Fluid ingress means 87 including an aperture 89 is provided in sheath 3 for receipt of quick-disconnect sleeve 95 and means 49 of hose 45 so that warm water from tank 1 may be transferred into sheath 73 to begin bathing of patient 55. Aperture 89 is provided with a one-way valve 91 that remains normally closed when not connected to hose 45 so as to prevent escape of water from sheath 73. Means 87 is preferably either molded into sheath 73 during manufacture or placed over aperture 89 that is cut or otherwise formed in the sheath and held there by heat sealing or adhesive or other process already known in the art.

An example of means 87 is a quick-disconnect type fitting having a pair of strong plastic collars 93 mounted in spaced-apart relation on either side of the sheath material adapted for receipt of a smooth, quick-disconnect sleeve 95 of hose connection means 49, having a spring-loaded extension that is depressed as quickdisconnect sleeve 95 is inserted into collars 93 and that springs partially outward when between the collars to hold the sleeve in place. In addition a one-way valve such as a flapper 97 is attached to collars 93 and biased thereagainst to prevent leakage of water from sheath 3 when sleeve 95 is removed. Such devices are known in the art and are commercially available. It has been found desirable to mount fluid ingress means 87 at one side of sheath 73 near where the patient's shoulders would be located.

A fluid egress means 99 is provided in sheath 73, preferably in under-body portion 77, at or near sheath foot-portion 85 for the purpose of draining water from sheath 73 after the bathing process nears completion. Such means 99 may be constructed in the same configuration as fluid ingress means 87. A separate rinse-water transfer hose 101 is provided for connection at one end 103 to fluid egress means 99 for the purpose of draining the rinse water from sheath 75.

Figure 3:
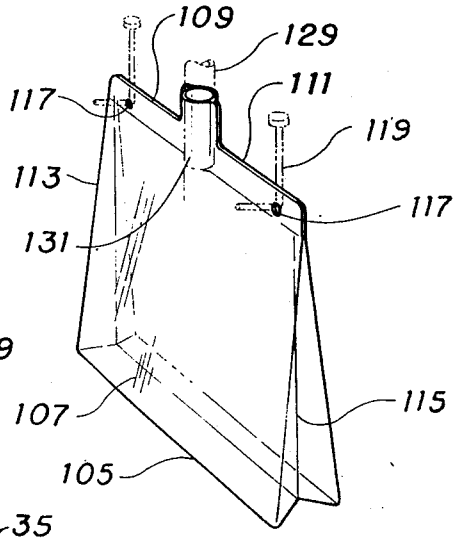
FIG. 3 is an illustrative view of the rinse-water receiving bag used in draining the rinse water from the sheath after bathing has been completed.
Figure 5:
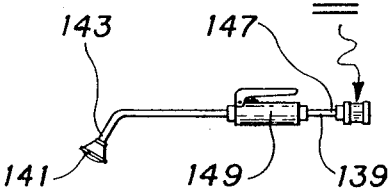

This inventive apparatus further includes a water-impervious rinse-water receiving bag 105, shown in FIG. 3, for use in collecting the rinse water at the patient's bed side thus eliminating the time-wasting task of draping a drain hose from sheath 73 to some remote drain in another room. In addition, this use of receiving bag 105 as hereinafter described insures full gravity flow thereby eliminating problems associated with using long drain lines that require suction to start them, especially where a sink contains the only drain and it is at or near the level of sheath 73 in the bed.

As shown, rinse-water receiving bag 105 comprises a bag made of a flat, wide strip 107 of water-impervious material whose ends 109 are joined together along a seam 111 that forms the top of the bag and whose side edges 113 are joined therealong at the periphery of a pair of spaced-apart end panels 115 to form an elongated, "carpet-bag" style enclosure. A pair of apertures 117 are formed in spaced-apart relation near seam 111 for receipt therethrough of a pair of hangers 119 mounted in the top surface of open compartment 39 formed in the front of cart 17. A port 121 is formed in the front of cart 17 for receipt of the other end 123 of rinse-water transfer hose 101. A tube 125 is mounted in cart 17 having one end 127 attached to port 121 and the other end 129 extending down into compartment 39 between hangers 119. An opening 131 is formed in bag seam 111 for receipt of tube end 129 when receiving bag 105 is suspended on hangers 119. Bed 61 is preferably raised at the top to force all the water in sheath 73 to run by gravity to sheath foot-portion 85 to allow total draining of all water from sheath 73.

A manually operated shut-off valve 133 is preferably installed in hose 45 to permit control of the flow of water from the pressurized water source into tank 1 and from the tank 1 into sheath 73. A similar shut-off valve 135 is installed in rinsewater transfer hose 101 to control the flow of water out of sheath 73 into rinse-water receiving bag 105. In addition, a rubber bumper 137 is provided at the front of cart base plate 19 to reduce the force of cart contact with the bed or other object that could cause disconnection of the hoses.

A short length of rigid tube 139 is provided having a shower nozzle 141 mounted at one end 143 and means 145 at the other end 147 for connecting it to means 49 on hose end 51. A normally-off, spring-loaded, hand-operated valve 149 is mounted in rigid tube 139. During and after the bathing process, hose 45 is disconnected from sheath fluid ingress means S and connected to rigid tube connection means 145. The patient may then be rinsed with a fine spray of water from tank 1 from shower nozzle 141 in through sheath slot 83 by the operator merely depressing spring-loaded valve 149.

To insure the water charged to tank 1 is in the comfortable temperature range, a temperature observation means 151 is provided. Means 151 may take many forms; as shown in FIG. 1, means 151 includes a temperature probe 153 mounted in fill pipe 41 located centrally in bottom tank end wall 5, a temperature information transmission line 155 extending from probe 153 to the top of cart cover 35 to a temperature readout gauge 157 mounted thereon.

Figure 4A:
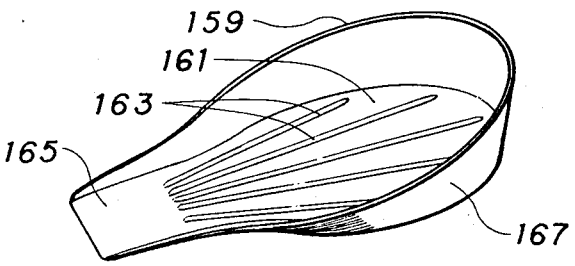
FIGS. 4*a* and 4*b* are illustrative views of the hair-washing dish usable in this invention for washing a person's hair; and, FIG. 5 is a side elevational plan view of one embodiment of the rinsing device of this invention.
Figure 4B:
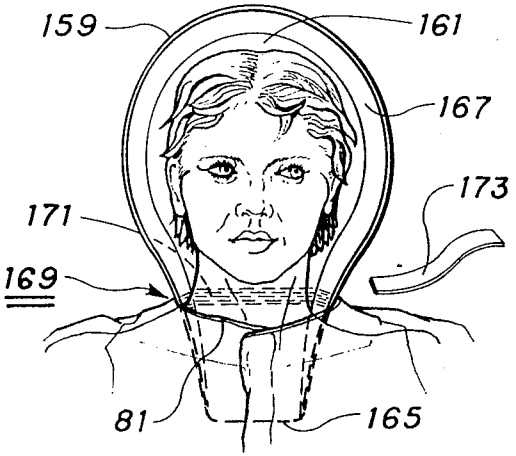

For those instances where patient 55 wishes their hair washed, a separate hair-washing dish 159 is provided. As shown in FIGS. 4*a* and 4*b*, dish 159 is comprised of a generally flattened base 161, larger in overall size, but generally in the shape of a person's head, having a plurality of gentle depressions or gullies 163 extending there across in a converging pattern toward a narrow portion 165 that extends from base 161 for insertion into sheath 73 through neck enclosing portion 81 under the patient's neck. Upstanding side walls 167 surround base 161 except for narrow portion 165 to prevent escape of wash water onto the bed linen.

Means 169 are provided in sheath neck enclosing portion 81 to temporarily secure sheath 73 to dish 159 to insure that movement of the patient's head or body during hair washing does not cause separation of the sheath from the dish and allow water to spill onto the bed. Means 169 may take many forms such as a pair of strips (male and female) of Velcro (trademark) mounted to neck enclosing portion 81 and to the bottom of dish base 161 respectively for joinder therebetween. Preferably, however, means 169 is a strip of adhesive 171 attached to neck enclosing portion 81 having a cover strip 173 placed thereon to prevent unwanted adhesive contact when not in use. Similarly, means 169 is also provided under one edge of sheath slot 83 to allow interconnecting or intersealing of slot 83 when so desired.

In this inventive in-bed bathing process, tank 1 is wheeled on cart 17 to a convenient location of a source of pressurized water where hose 45 is connected thereto and valve 133 opened to allow first tank compartment 11 to fill with warm water. The temperature is monitored by observing means 151 and the spigot faucets manipulated to control the amount of hot and cold water being charged thereto. As water is pressurized into tank compartment 11, diaphragm 9 is distended into second compartment 13 (as shown in dotted outline in FIG. 1) thereby compressing the air entrapped therein and developing a reverse pressure to be later applied to the water. Shut-off valve 133 is then closed and hose 45 disconnected from the water source and cart 17 and tank 1 wheeled to the patient's bedside. An unused, folded sheath 73 is extracted from depression 37 and unfolded alongside patient 55. The patient is rolled first on one side, then the other, while sheath over-body portion 75 is arranged under his/her back along slot 83 so that when finally rolled onto his/her back, the patient lies on sheath under-body portion 77 and sheath over-body portion 75 is pulled up over the body to enclose it therein except for the head which exits sheath 73 at neck-enclosing portion 81.

If the hair is to be washed, dish 159 is placed under the head and adhesive strip-cover 173 is peeled from adhesive strip 171 and neck-enclosing portion 81 is arranged under narrow dish portion 165 and pressed into adherence therewith.

Hose 45 is then connected from tank 1 into fluid ingress means 87 and valve 133 opened to cause pressurized warm water from tank 1 to pass into sheath 73. Valve 133 is then closed and the patient washed either from outside sheath 73 or the provider may reach in through slot 83 for direct contact to bathe the patient. Hose 45 is then disconnected from sheath 73. An empty rinse-water receiving bag is removed from storage in depression 37 in cart 17, unfolded and hung on hangers 119 making sure that tube end 129 extends down into bag opening 131. Rise-water transfer hose 101 is then connected between sheath 73, at fluid egress means 99 and port 121 on cart 17. Shut-off valve 135 is then opened. Hose 45 is then connected to rigid tube 139 and the patient rinsed by using shower nozzle 141 and depressing hand-operated, spring load valve 149. Washing the patient's hair is accomplished in dish 159. When rinsing the patient's hair, the rinse water will pass down depressions 163 and into narrow portion 165 then down under the patient's neck into sheath 73. The top of bed 61 may be slightly elevated (if possible) to aid in draining sheath 73. Thereafter, the patient may be rolled on his/her side, sheath 73 rolled up and towels placed under the patient's back, rolled to the other side, sheath 73 completely rolled up, folded and discarded, and more towels used to dry the patient's body. Hair washing dish 159 may also be removed and replaced with dry towels. Rinse-water transfer hose 101 may then be raised to drain it into collection bag 89, shut-off valve 135 closed, and hose 101 disconnected. Later, cart 17 may be wheeled to a sink where bag 105 may be removed from hangers 119 and tube 125 and emptied.

One of the salient features of this invention, both in the in-bed bathing process and in the apparatus, is the complete separation of contact between the patient and the provider of services. While one generally preferred embodiment has been described in detail, others are possible, within the general meaning vein the terms herein and these other embodiments are fully contemplated herein.

What is claimed is:

1. An in-bed, portable bathing apparatus comprising:

(a) a sealed tank containing an internal flexible diaphragm that divides the tank interior into a first compartment for holding water under pressure and second compartment containing air;

(b) a cart for holding said tank securely therein including wheels and a handle for moving said cart from place-to-place on said wheels;

(c) a flexible hose connected at one end to said first compartment and containing means for connecting the other end to a pressurized water source;

(d) a valve in said hose to allow flow of pressurized water from a pressurized water source into said first compartment thereby distending said diaphragm into said second compartment whereby air in said second compartment will be compressed by movement of said diaphragm to create internal pressure on the incoming water;

(e) a full-length, body-encapsulating, fluid-impervious sheath to accommodate and completely enclose a person's body, except for the head, and generally defining over-body and under-body portions joined together about their periphery, except for a narrow portion at the head thereof for enclosing the neck therein, to allow a person encapsulated therein to turn or roll over within said sheath;

(f) an elongated opening in said over-body portion dimensioned to permit passage therethrough of the person's body in a generally supine or prone posture;

(g) fluid ingress means including a one-way valve attached to said sheath generally midpoint and to one side of said over-body portion;

(h) fluid egress means including a one-way valve attached to said sheath at said under-body portion; and, (i) a fluid-impervious, rinse-water receiving bag for interconnection with said sheath to receive the rinse water from said sheath following completion of bathing.

2. The in-bed, portable bathing apparatus of claim 1 further including a hair-washing dish comprising a generally flattened base having a narrow extended portion for insertion into said neck enclosable end of said sheath under the person's neck, said base surrounded by upstanding sidewalls for cradling the head therein to wash and rise the person's hair.

3. The in-bed, portable bathing apparatus of claim 2 further including means for temporarily affixing said neckenclosing portion of said sheath to the underside surface of said hair-washing dish adjacent said narrow, extended portion thereof.

4. The in-bed, portable bathing apparatus of claim 1 further including visual temperature indicator means operably connected to said first compartment to allow close observation of the temperature of the water charged to said first compartment.

5. The in-bed, portable bathing apparatus of claim 1 further including means of said cart to store a plurality of unused body sheaths and unused rinse-water receiving bags in collapsed, folded configuration and means for hanging one of said rinse-water receiving bags in an unobstructed position on said cart during draining of the rinse water from said sheath.

6. The in-bed, portable bathing apparatus of claim 1 further including a short length of rigid tubing containing a shower nozzle at one end and means at the other end for connection to said flexible hose for dispensing a pattern of fine droplets of pressurized water on the person's body through said elongated opening to rinse the person.

7. The in-bed, portable bathing apparatus of claim 6 further including a normally-closed, hand-operated valve in said hose for controlling the flow of water therethrough.

8. The in-bed, portable bathing apparatus of claim 1 further including means for temporarily closing said elongated opening of said body sheath.

* * * * *